US006763816B1

(12) United States Patent
Nakabayashi et al.

(10) Patent No.: US 6,763,816 B1
(45) Date of Patent: Jul. 20, 2004

(54) INTERNAL COMBUSTION ENGINE IGNITION COIL

(75) Inventors: Kenji Nakabayashi, Hitachinaka (JP); Junichi Shimada, Pfaffenhofen (DE); Noboru Sugiura, Mito (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/009,366

(22) PCT Filed: Jun. 9, 1999

(86) PCT No.: PCT/JP99/03076

§ 371 (c)(1),
(2), (4) Date: Dec. 10, 2001

(87) PCT Pub. No.: WO00/75936

PCT Pub. Date: Dec. 14, 2000

(51) Int. Cl.[7] ..... F02P 13/08
(52) U.S. Cl. ..... 123/634; 336/96
(58) Field of Search ..... 123/634, 594; 336/90, 96

(56) References Cited

FOREIGN PATENT DOCUMENTS

| | | |
|---|---|---|
| JP | 57178427 | 11/1982 |
| JP | 9129470 | 5/1997 |
| JP | 9120925 | 6/1997 |
| JP | 10149934 | 2/1998 |
| JP | 10289831 | 10/1998 |
| JP | 11-111545 | 4/1999 |
| JP | 11224824 | 8/1999 |

*Primary Examiner*—Bibhu Mohanty
(74) *Attorney, Agent, or Firm*—Crowell & Moring LLP

(57) ABSTRACT

An independent ignition type ignition coil for an internal combustion engine, comprising, arranged concentrically in a coil case (6) and with the innermost one mentioned first, a center core (1), a secondary coil (3) wound on a secondary bobbin (2) and a primary coil (5) wound on a primary bobbin (4), with epoxy resin (8) and soft epoxy (17) filled between these component members, wherein a coating is formed on the outer surface of the primary coil (5) so as to facilitate the separation from the epoxy resin (8) and the presence of this separation portion (50) between the primary coil (5) and the resin and in an interlayer of the primary coil (5) can reduce from a thermal stress produced within the secondary bobbin (2) a stress which is produced in the secondary bobbin by a heat contraction difference between the primary coil (5) and the secondary bobbin, thereby reducing the thermal stress of the secondary bobbin of the independent type ignition coil exposed to a rigorous temperature environment to prevent bobbin cracking and ensure an integrity of electrical insulation.

8 Claims, 10 Drawing Sheets

INTERNAL COMBUSTION ENGINE IGNITION COIL

TECHNICAL FIELD

The present invention relates to an independent ignition type ignition coil for an internal combustion engine which is installed in a plug hole of the engine to be directly coupled with each spark ignition plug.

BACKGROUND ART

Since such independent ignition type ignition coil is introduced at least a part of a coil portion within a plug hole and installed therein, a center core (in which a plurality of silicon steel plates are stacked on a magnetic path iron core), a primary coil and a secondary core are housed with a thin cylindrical coil casing. A high voltage necessary for spark ignition is generated in the secondary coil by controlling supply and block of a current for the primary coil. These coils are normally wound on respective bobbins and are arranged around the center core in coaxial fashion.

As the ignition coil of this kind, there are a so-called outer secondary coil structure, in which the primary coil is arranged inside and the secondary coil is arranged outside, and a so-called inner secondary coil structure, in which the secondary coil is arranged inside and the primary coil is arranged outside. Amongst, the latter is considered to be advantageous in comparison with the former in view point of output characteristics for shorter overall length of the secondary coil in comparison with the former and smaller electrostatic stray capacitance.

Namely, a secondary voltage output and a rising characteristics thereof are affected by the electrostatic stray capacitance to lower the output and to delay rising at greater electrostatic. Accordingly, the secondary coil having smaller electrostatic stray capacitance is considered to be more suitable for down-sizing and higher output.

Within the coil casing housing the primary and secondary coils, insulation ability of the coils is assured by filling an insulative resin (filled and cured).

However, when an epoxy resin is filled (filling and curing) between the components of the ignition coil assembly, since curing temperature of the epoxy resin is typically higher than or equal to 100° C., and at normal temperature, the insulative resin and bobbin material are exerted thermal stress due to different of linear expansion coefficients of the components (difference of linear expansion coefficients of bobbin, coil, center core and the insulative resin). Thus, it becomes necessary to provide a measure for preventing crack and interfacial delamination between the materials due to thermal stress.

In Japanese Patent Application Laid-open No. Heisei 11-111545, there has been disclosed an ignition coil of inner secondary coil structure, in which the insulative resin is filled (filled and cured) within a coil casing housing therein the primary and secondary coils. On the other hand, there has been disclosed that even if the resin insulation material penetrates between the wire of the primary coil, sliding may be caused the wire of the primary coil and the resin insulation material by coating wire of the primary coil by a material which is difficult to be bonded by the insulative resin to be filled.

However, in the prior art, when the primary coil and the insulative resin are tightly fitted, the surface of the primary coil can be scratched by the insulative resin to cause peeling off of the coating.

DISCLOSURE OF THE INVENTION

It is an object of the present invention to make an ignition coil assembly of this kind high quality and high reliability by reducing a thermal stress due to a difference of linear expansion coefficients (difference of linear expansion coefficients of bobbin, coil, center core and insulative resin) between components without causing break down of electrical insulation of a primary coil.

In order to accomplish the above-mentioned object, (1) Namely, the first invention is that in an independent ignition type ignition coil for an internal combustion engine to be used by directly connecting with each ignition plug of the internal combustion engine, in which a center core, a secondary coil wound around a secondary bobbin, and a primary coil wound around a primary bobbin are coaxially arranged in sequential order from inside within a coil casing, and insulative resin being filled between these components, a gap portion for reducing stress generated within the secondary bobbin by thermal shrinkage difference of the first coil and the secondary bobbin among thermal stress created within the secondary bobbin, is provided together with the insulative resin between the primary bobbin and the primary coil and between the layers of the primary coil.

This gap is at least one delaminated portion formed between "the insulative resin (for example, epoxy resin) filled between the primary bobbin and the primary coil" and the "primary coil", between the "insulative resin filled between the primary bobbin and the primary coil" and the "primary coil", and between the "primary coil" and "insulative resin filled between layers of the primary coil".

As more particular mode of implementation, the primary coil is provided with the coating film or coating which is easy to delaminate between the primary coil and the insulative resin filled around the primary coil, is provided with the coating film or coating easy to delaminate between the bobbin surface and the insulative resin contacting on the bobbin surface, and is provided, in place with the coating film or coating, with an insulative sheet having low bonding ability with epoxy.

As these coating film or coating, overcoating containing material having small friction coefficient, such as nylon, polyethylene, Teflon or the like and material having small bonding ability with epoxy resin is used.

After curing epoxy, when temperature is lowered, delamination is caused in the portion having small tension stress at the interface between epoxy and the primary coil or the primary bobbin and small bonding ability with epoxy, due to difference of linear expansion coefficients of copper and epoxy.

As an effect of the present invention, when thermal shrinkage is caused in the ignition plug by lowering of temperature after stopping operation of the engine, relative expansion force in circumferential direction acts on the secondary bobbin by thermal shrinkage difference (linear expansion coefficient difference). On the other hand, from the primary coil and the secondary coil, tension force acts on the secondary coil relatively in circumferential direction via the insulativeresin. By multiplier effect of these, large internal stress $\sigma$ is created in the secondary bobbin. In the present invention, by interposing the gap (for example, the foregoing delaminated portion) between the primary bobbin and the primary coil and/or between the layers of the primary coil, it becomes possible to block transmission path of the tension force in the circumferential direction otherwise acting on the secondary bobbin from the primary coil.

Accordingly, among the stress σ created within the secondary bobbin, by reducing the stress component σ1 created within the secondary bobbin by thermal shrinkage difference of the primary bobbin and the secondary bobbin, total internal stress σ can be significantly reduced (weaken). By examples of CAE (Computer Aided Engineering) analysis made by the inventors, by reducing the foregoing stress component σ1, at least 20% of the total internal stress can be reduced. The reduction value of the internal stress was confirmed in connection with the ignition coil inserted into the plug hole of the internal combustion engine to be directly connected to the ignition plug, and the outer diameter of the inserted portion is ø18 to ø27 mm (the thin cylindrical type ignition coil of this size typically has 0.5 to 1.2 mm of thickness of the primary bobbin, 0.7 to 1.6 mm of thickness of the secondary bobbin, and 50 to 150 mm of bobbin length).

Even when the foregoing gap (for example, laminated portion) is provided between the primary bobbin and the primary coil and/or between the layers of the primary coil, since the primary coil is low potential (substantially ground potential), concentration of electric field between the primary coil will never be caused. Also, by tightly fitting the secondary coil, the insulative resin and the primary bobbin without gap, insulation between the primary coil and the secondary coil can be sufficiently assured. It has also been confirmed by the result of test that concentration of electric field by line voltage of the secondary coil can be satisfactorily prevented. Thus, insulation break down can be prevented.

(2) Furthermore, in addition to the foregoing first invention, when modified PPE (modified polyphenylene ether) is used for the secondary bobbin, the internal stress σ can be further reduced in viewpoint of improvement of material of the secondary bobbin by containing inorganic filler (glass fiber, Mica, Talk or the like) in the content of greater than or equal to 20% in the secondary bobbin.

Modified PPE is superior in bonding ability with epoxy resin serving as the insulative resin, and has good molding ability and insulation ability. Therefore, it can contribute for quality stability of the secondary bobbin. When the inorganic filler content is less than 20%, the difference of linear expansion coefficients with other component (center core, primary coil, secondary coil or the like) becomes large to make the internal stress (thermal stress) σ large, For example, according to the example of CAE analysis, if the foregoing σ1 is not reduced, the internal stress σ created in the secondary bobbin becomes as large as about 90 to 100 MPa upon occurrence of abrupt temperature drop if the ignition coil is placed in temperature environment varying from 130° C. to −40° C.

In contrast to this, according to the present invention, the internal stress σ can be lowered to be less than or equal to 70 MPa to successfully prevent longitudinal cracking of the secondary bobbin. It should be noted that as optimal example of lowering of the internal stress σ with maintaining bolding ability (flowability of the resin) of the secondary bobbin, it is proposed a material containing 45 to 60 Wt % of modified PPE, 15 to 25 Wt % of glass fiber, 15 to 35 Wt % of non-fibric inorganic filler. The detail will be discussed in the discussion of the embodiment.

Furthermore, in viewpoint of the linear expansion coefficient lowering the foregoing internal stress σ, particularly, when resin flow direction in resin molding is axial direction of the bobbin, the linear expansion coefficient in the direction perpendicular to the resin flow direction (it becomes important point for preventing longitudinal cracking of the bobbin to suppress internal stress in the direction corresponding to radial direction and circumferential direction of the bobbin, particularly in circumferential direction) of 35 to $75\times10^{-6}$ in average at −30° C. to −10° C. in test method according to ASTM D 696. Detail of this will be discussed in the discussion of the embodiment.

As more particular embodiment, by forming the coating film or coat layer on the outermost layer of the primary coil containing component having no affinity or causing no chemical reaction with the insulative resin (for example, epoxy resin), delamination is caused between the primary coil and the insulative resin to form the gap portion. The component having no affinity or causing no chemical reaction with the insulative resin is the material expressed by $-(CH_2CH_2)-n(n\geqq2)$ or $-[CH_2—CH(CH_3)]-n(n\geqq2)$, for example, nylon, polyorefin such as polyethylene, polypropylene or the like, fruorinated resin, fluorinated ester, fluorinated rubber, wax, fatty acid ester.

BEST MODE FOR IMPLEMENTING THE INVENTION

Embodiments of the present invention will be discussed with reference to the drawings.

Figure 1:
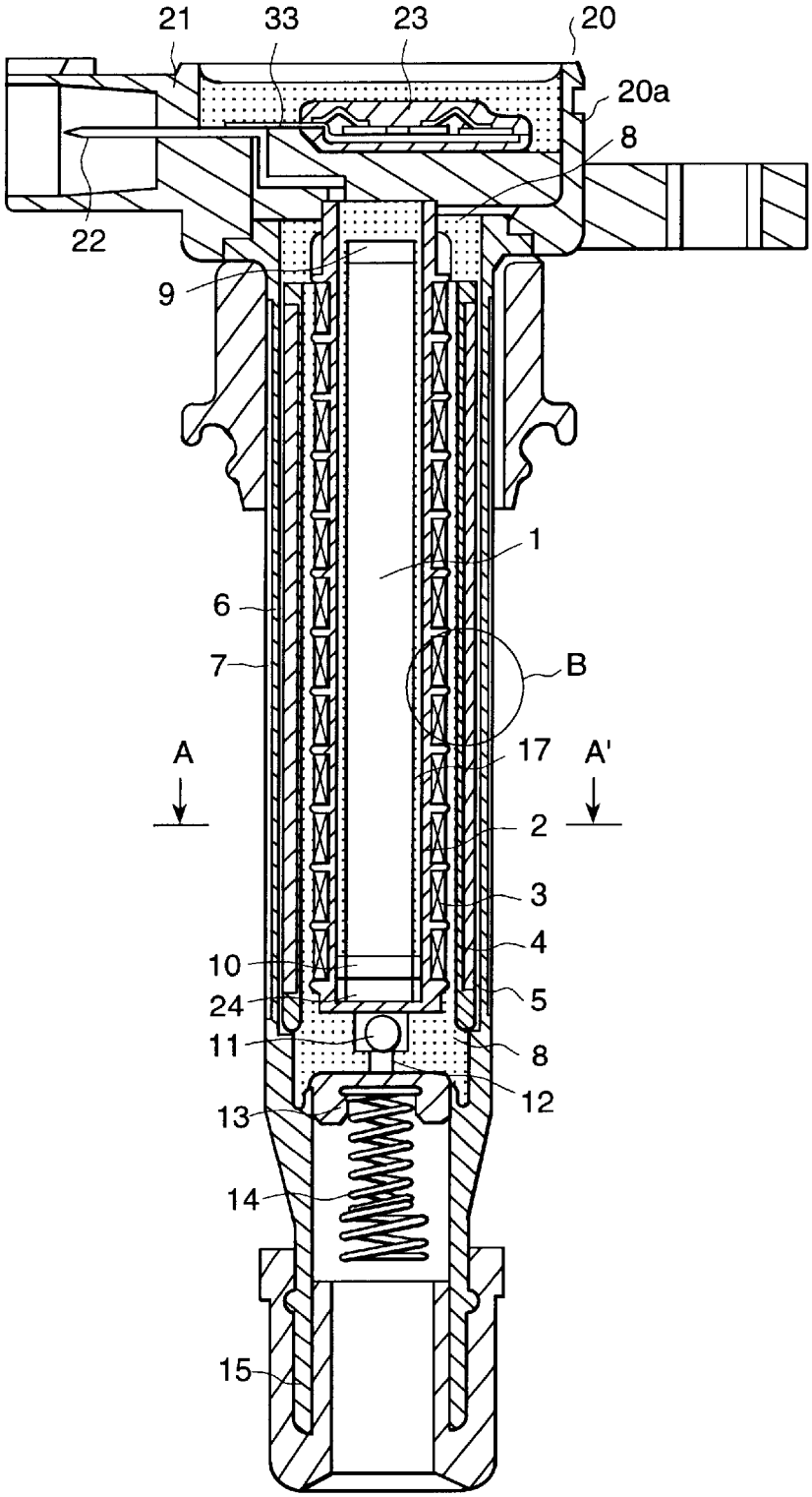
FIG. 1 is a longitudinal section of one embodiment of an ignition coil for an internal combustion engine according to the present invention.
Figure 2:
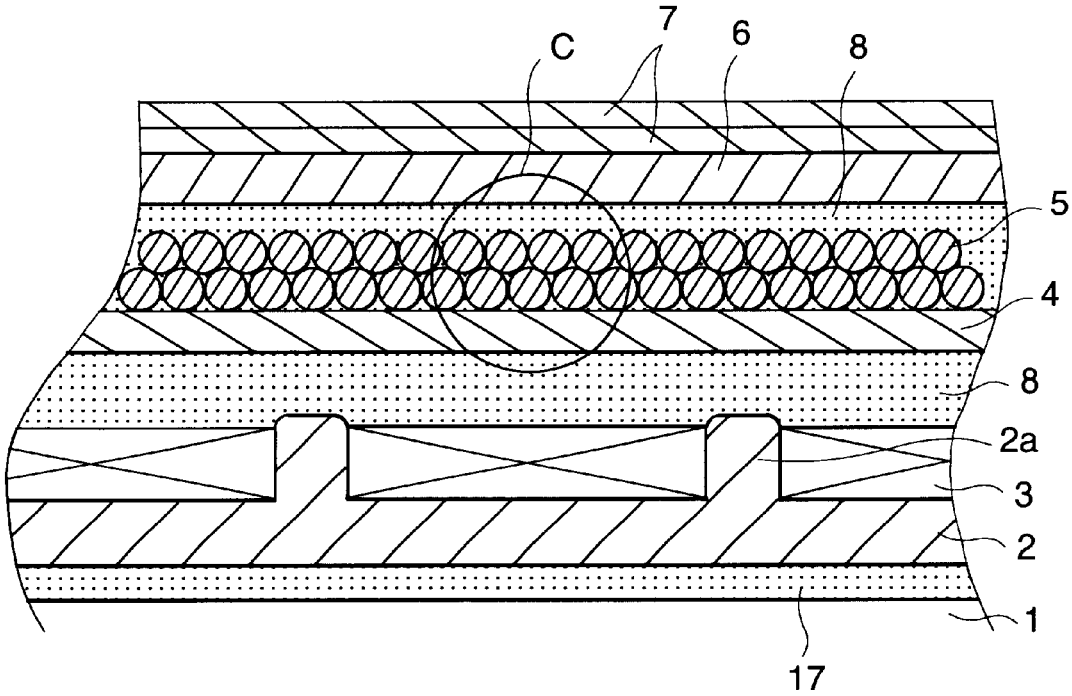
FIG. 2 is an enlarged illustration showing a portion B of FIG. 1 in a condition enlarged and transversely oriented.
Figure 3:
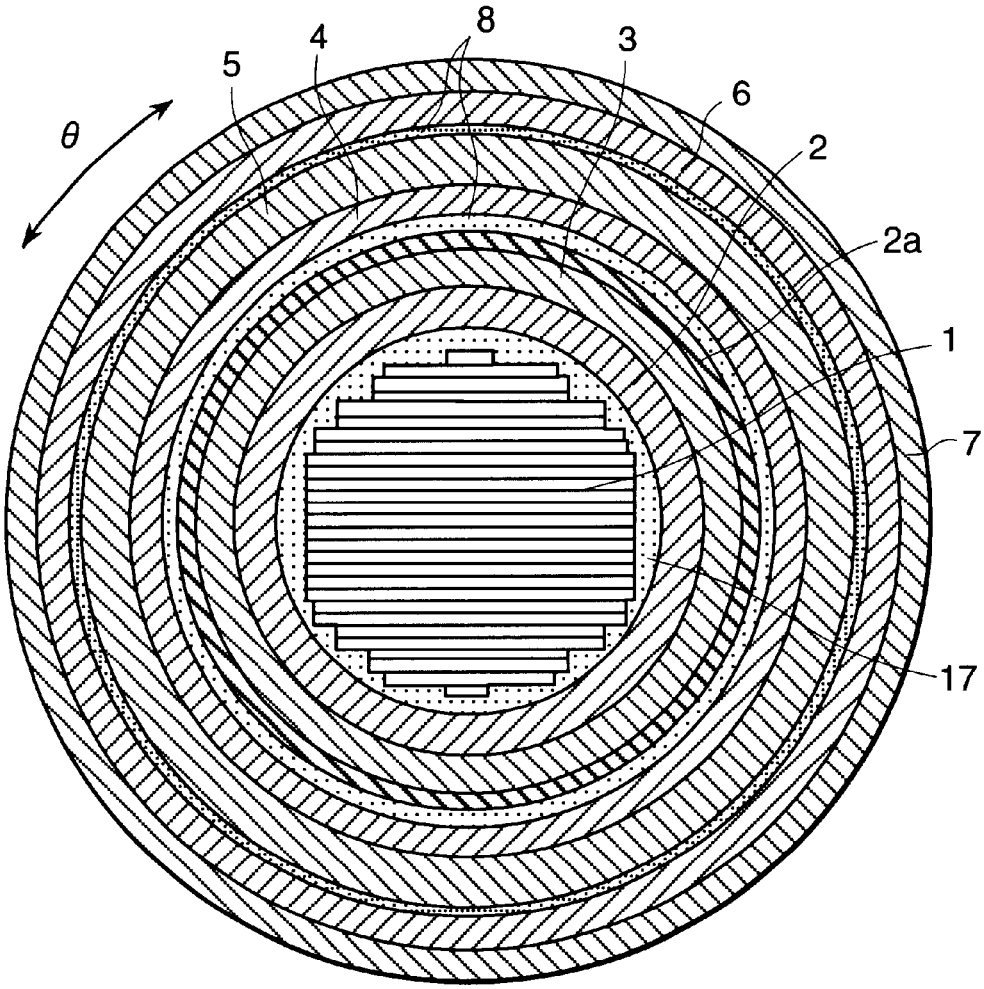
FIG. 3 is a cross section taken along line A–A' of FIG. 1.

FIG. 1 is a longitudinal section of one embodiment of an ignition coil for an internal combustion engine according to the present invention, FIG. 2 is an enlarged illustration showing a portion B of FIG. 1 in a condition enlarged and transversely oriented, and FIG. 3 is a cross section taken along line A–A' of FIG. 1.

Within a thin cylindrical casing (outer casing) 6, a center core 1, a secondary coil 3 wound around a secondary bobbin 2 and a primary coil 5 wound around a primary bobbin 4 are arranged in coaxial fashion from center (inside) to outside. On outside of the outer casing 6, a side core forming a magnetic path with the center core 1 is mounted.

The center core 1 is formed by stacking a large number of silicon steel plates or directional silicon steel plates set widths into several stages, by press for increasing sectional area, as shown in FIG. 3, for example. On both ends in axial direction of the center core 1, magnets 9 and 10 are arranged adjacent the center core 1. The magnets 9 and 10 are adapted to operate the ignition coil lower than or equal to saturation point of magnetization curve of the core by generating a magnetic flux in opposite direction to the magnetic flux of the coil passing through the center core 1. The magnet may also be arranged only at one end of the center core 1. The reference numeral 24 denotes an elastic body (for example, rubber) absorbing thermal expansion in axial direction of the center core 1.

As shown in FIG. 2, between the center core 1 inserted within the secondary bobbin 2 and the secondary bobbin 2, so-called soft epoxy resin (flexible epoxy) 17 is filled, and within gaps between respective components of the secondary bobbin 2, the secondary coil, the primary bobbin 4, the primary coil 5 and the outer casing 6, hard epoxy resin (thermosetting epoxy resin) is filled.

The soft epoxy resin 17 is epoxy resin having soft property (elastmer) having glass transition point lower than or equal to a normal temperature (20° C.) and having elasticity at a temperature higher than or equal to the glass transition point, and can be a mixture of epoxy resin and modified fatty series polyamine (thermosetting epoxy resin) 8, for example.

The reason why soft epoxy resin 17 is selected as the insulative resin between the center core 1 and the secondary bobbin 2, is that so-called pencil coil (independent ignition type ignition coil of the type to be inserted into a plug hole) is faced to severe temperature environment (thermal stress in a temperature range between about −40° C. to 130° C.), and in addition thereto, since the difference between the linear expansion coefficient of the center core 1 ($13\times10^{-6}$) of the center core 1 and the linear expansion coefficient of the hard epoxy resin of the hard epoxy region ($40\times1^{-6}$) is large, if ordinary epoxy resin (epoxy resin composition harder than soft epoxy resin 17) is used, crack may be formed in the epoxy resin by a heat shock to cause insulation break down. Namely, as a measure for the heat shock, the soft epoxy resin 17 which is an elastic body superior for absorbing heat shock and has insulation ability, is used.

Here, discussion will be given for the secondary bobbin 2. The shown embodiment of the secondary bobbin 2 is based on the following finding.

① The secondary bobbin 2 satisfies a condition of [allowable stress of secondary bobbin $\sigma\mathbf{0}$> (stress to be generated at (−40 C. −glass transition point Tg of soft epoxy resin 17) $\sigma$]. Here, as one example, the secondary bobbin having the soft epoxy resin which has glass transition point Tg at −25° C., will be discussed as example.

For example, when the glass transition point Tg of the soft epoxy resin 17 is −25° C., when the secondary bobbin 2 causes shrinkage to cause temperature drop after stopping operation of the internal combustion engine as placed in the environment causing temperature variation from 130° C. to −40° C., shrinkage of the secondary bobbin 2 in the temperature range from 130° C. to −25° C. can be accommodated by elastic absorption of the soft epoxy resin 17. Therefore, among thermal stress $\sigma$ to be caused within the secondary bobbin 2, a component exerted from the center core 1 is substantially zero. It should be appreciated that as a whole, when thermal shrinkage of the secondary bobbin 2 is caused, the primary coil 5 and the secondary coil 3 having smaller linear expansion coefficient (thermal expansion coefficient) than the secondary bobbin 2 suppresses thermal shrinkage of the secondary coil 3 via the hard epoxy resin 8. In other words, the primary coil 5 and the secondary coil 3 apply tension force in peripheral direction relative to the secondary bobbin 2. By this, a sum of thermal stress component $\sigma\mathbf{1}$ acting from the primary coil 5 and thermal stress component $\sigma\mathbf{3}$ acting from the secondary coil 3 becomes a major component of an internal stress $\sigma$ of the secondary bobbin 2.

In a temperature range from −25° C. to −40° C., the soft epoxy resin 17 transits to glass state. By this, shrinkage (deformation) of the secondary bobbin 2 is also prevented from the side of the center core 1. Therefore, a thermal stress $\sigma\mathbf{3}$ applied by a force from the center core side is added to thermal stresses $\sigma\mathbf{1}$ and $\sigma\mathbf{2}$ applied by the primary coil and the secondary coil set forth above. A stress as a sum of these $\sigma\mathbf{1}$, $\sigma\mathbf{2}$ and $\sigma\mathbf{3}$ becomes a major component of the internal stress $\sigma$ of the secondary bobbin 2.

The thermal stress $\sigma$ caused in the secondary bobbin 2 is expressed by $\sigma=E\cdot å=E\cdot\alpha\cdot T$. E is a Young's modulus, å is a strain,$\alpha$ is a linear expansion coefficient of the secondary bobbin and T is a temperature variation (temperature difference). When the allowable stress $\sigma\mathbf{0}$ of the secondary bobbin 2 is greater than the generated stress $\sigma$ ($\sigma<\sigma\mathbf{0}$), breakage of the secondary bobbin 2 is not caused.

② material of the secondary bobbin 2 is to be selected a material having good bonding ability with the epoxy resin 8. When bonding ability with the epoxy resin 8 is low, delamination is caused between the secondary bobbin 2 and the epoxy resin 8 to potentially cause insulation break-down.

Here, discussion will be given for a mechanism of insulation break-down upon occurrence of delamination (including formation of crack of the insulative resin) between the insulative resin and the bobbin material with reference to FIG. 8.

Figure 8:
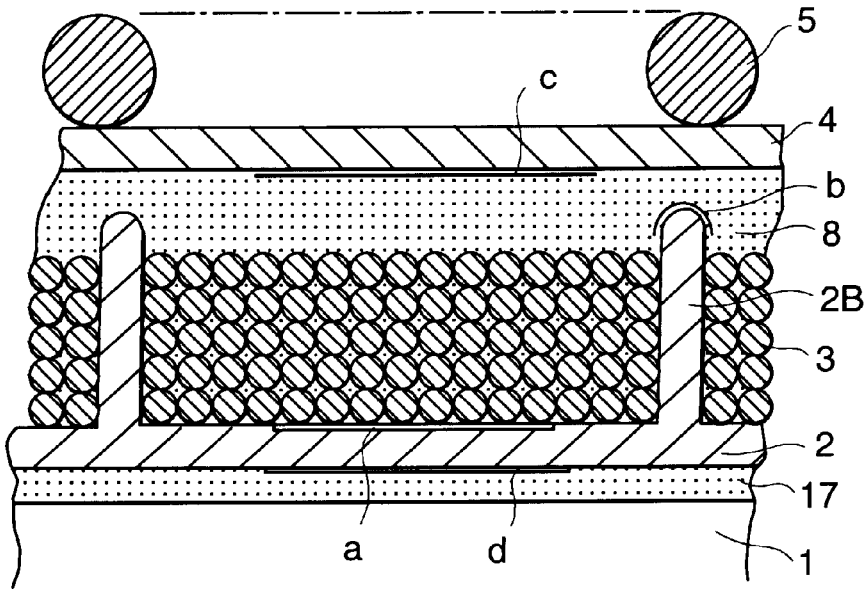
FIG. 8 is a diagrammatic illustration showing a mode of insulation break down in the case where crack is caused in respective portion of the ignition coil.

FIG. 8 shows a part of the pencil coil of inner secondary coil structure in enlarged form, and is a partial enlarged section of the case where a plurality of collars (collars for setting respective spool area) 2B for separately winding the secondary coils are arranged on the outer surface of the secondary bobbin 2 in spaced apart in axial direction.

Among the epoxy resin 8, the epoxy resin 8 to be filled between the secondary bobbin 2 and the primary bobbin 4 reaches the outer surface of the secondary bobbin 2 as penetrated between wire of the secondary coil in addition between the secondary coil 3 and the primary bobbin 4 by lamination (vacuum pressure impregnation). On the other hand, between the center core 1 and the secondary bobbin 2, the soft epoxy resin 17 is filled as set forth above.

In this case, when contact strength (bonding strength) between the insulative resin and the secondary and primary bobbins is low, delamination can be caused between the secondary bobbin 2 and the insulative resin 8 penetrating into the secondary coil as shown by reference sign I, and between the collar of the secondary bobbin and the insulative resin 8 as shown by reference sign II. On the other hand, regions between the insulative resin 8 and the primary bobbin 4 as shown by reference sign III and between the insulative resin 17 and the secondary bobbin 2 as shown by reference sign IV are considered as regions potentially causing delamination.

When delamination is caused at the position shown by the reference sign I, concentration of electric field can be caused by line voltage of the secondary coil 3 through a delaminated portion (gap) to cause partial discharge between wire of the secondary coil 3 to generate heat resulting in burning out of enamel coating of the wire of the secondary coil to cause layer shorting. On the other hand, when delamination is caused in the position shown by the reference sign II, concentration of electric field is caused between wire between the separately wound adjacent areas of the secondary coil 3 to cause layer shorting due to partial discharge similarly to the above. When delamination is caused in the position shown by the reference sign III, insulation break down is caused between the secondary coil 3 and the primary coil 5. When the delamination is caused in the position shown by the reference sign IV, insulation break down is caused between the secondary coil 3 and the center core 1.

In the shown embodiment, in order to satisfy the foregoing condition, modified PPE superior in bonding ability with the epoxy resin is used as the material of the secondary bobbin 2. This material contains inorganic substance (glass filler, Mica or the like) for certainly providing reinforcement. Furthermore, in the shown embodiment, in order to satisfy the foregoing condition, namely, for making the linear expansion coefficient $\alpha$ of the secondary bobbin as small as possible and for realizing the foregoing allowable stress $\sigma 0 > \sigma$, inorganic substance is contained in a content greater than or equal to 20 Wt %, and more preferably greater than or equal to 30%. On the other hand, in order to assure injection molding ability of the secondary bobbin 2, it is necessary to improve fluidability of the resin in molten condition. The inorganic substance may be not only fiber type, such as glass filler or the like but also non-fibric inorganic substance, such as Mica or the like.

Figure 10:
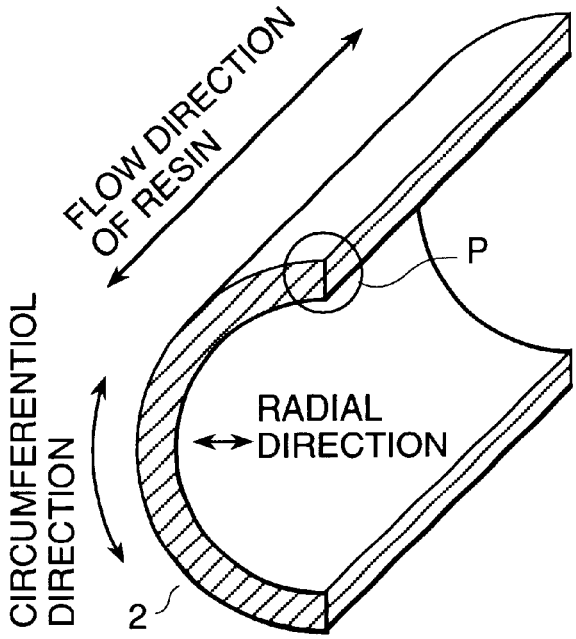
FIG. 10 is a diagrammatic illustration showing a condition where a part of a secondary bobbin to be employed in the foregoing embodiment is cut into half to be locally sectioned.
Figure 11:
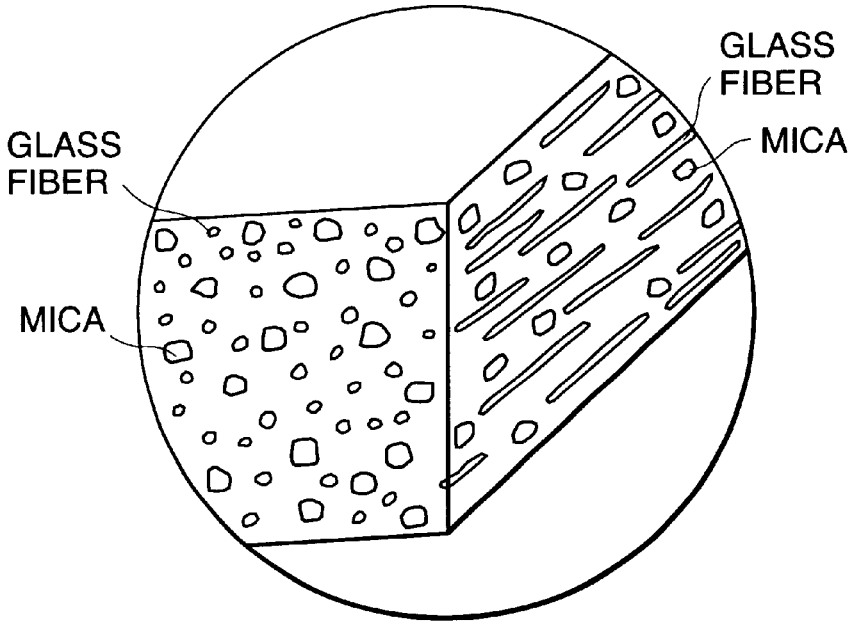
FIG. 11 is an enlarged section of a portion P of FIG. 10.

FIG. 10 shows a sectional perspective view showing a part of the secondary bobbin in the shown embodiment illustrated in cut into half. Flow direction of the resin upon molding of the secondary bobbin of the shown embodiment is axial direction of the bobbin, and diametrical direction and circumferential direction of the bobbin is perpendicular direction relative to the flow direction of the resin of the secondary bobbin. FIG. 11 is an illustration diagrammatically showing the portion P of FIG. 10 in enlarged form. Glass fiber as filler is oriented in the resin flow direction. Accordingly, linear expansion coefficient of the secondary bobbin in the axial direction is sufficiently small in comparison with the diametrical direction and circumferential direction perpendicular to the axial direction. When the linear expansion coefficients in the diametrical direction and circumferential direction are desired to make smaller without sacrificing flowability of the resin, it becomes necessary to make linear expansion coefficients in diametrical direction and circumferential direction by admixing a non-fibric filler material (e.g. Mica, talk or the like) in addition to glass fiber. In order to withstand to inner stress (thermal stress) $\sigma$, the secondary bobbin 2 is required to make the linear expansion coefficient in circumferential direction of the bobbin (perpendicular direction with respect to the resin flow direction).

Figure 13:
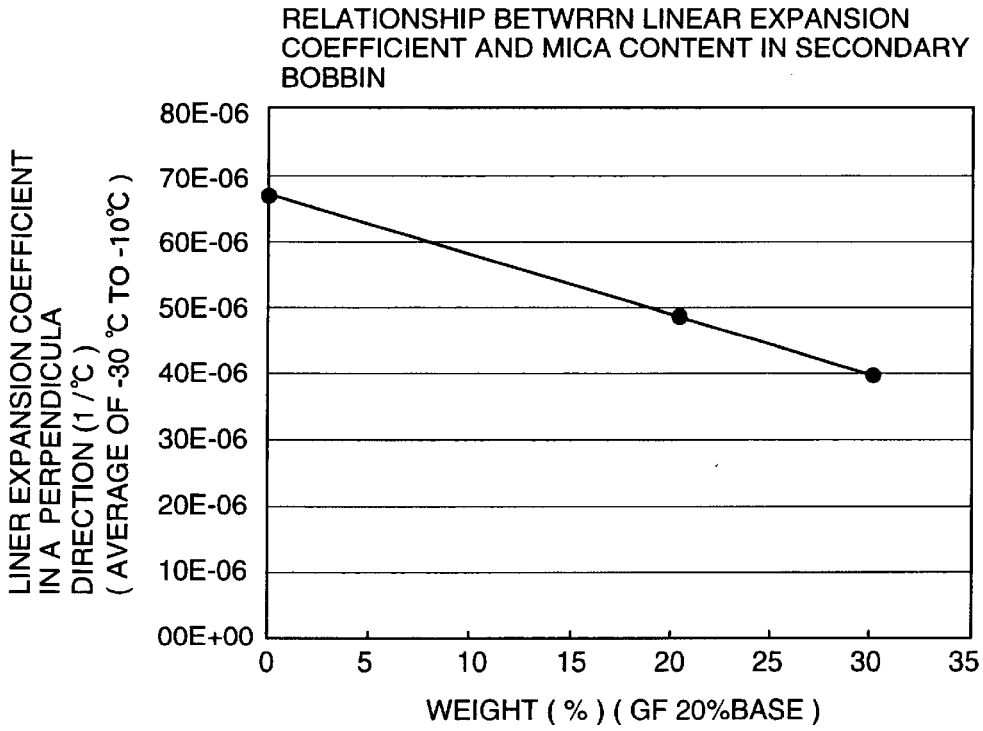
FIG. 13 is a diagrammatic illustration showing a relationship between a content of Mica in the secondary bobbin and the linear expansion coefficient.

FIG. 13 shows a relationship between the Mica content and linear expansion coefficient in a direction perpendicular to the resin flow direction (average linear expansion coefficient of −30° C. to −10° C. in a test method in accordance with ASTM D 696) in the case where the secondary bobbin 2 is formed with modified PPE (base containing 20 Wt % of glass fiber). In FIG. 13, E-6 represents $10^{-6}$. In this case, inorganic filler is 20 Wt % in total (20 Wt % of glass fiber, 0 Wt % of Mica) and the linear expansion coefficient is about $70\times10^{-6}$ (in case of test example, $49.3\times10^{-6}$). When the inorganic filler is 20 Wt % of glass fiber and 20 Wt % of Mica, the linear expansion coefficient is about $50\times10^{-6}$ (in case of the test example, $49.3\times10^{-6}$). When the inorganic filler is 20 Wt % of glass fiber and 30 Wt % of Mica, the linear expansion coefficient is about $40\times10^{-6}$ (in case of the test example, $39.6\times10^{-6}$). For example, when the linear expansion coefficient is desired to restrict in a range of about 40 to $50\times10^{-6}$, if content of glass fiber is 20 Wt %, the content of Mica becomes 20 to 30 Wt %. When the content of glass fiver is 15 to 25 Wt %, and the linear expansion coefficient is desired to restricted in a range of about 40 to $50\times10^{-6}$, required content of Mica becomes 15 to 35 Wt %. More particularly, modified PPE is 45 to 60 Wt %, glass fiber is 15 to 25 Wt % and Mica is 15 to 35 Wt %. As optimal example, in the shown embodiment, the secondary bobbin 3 contains 55 Wt % of modified PPE, 20 Wt % of glass fiber and 30 Wt % of Mica. As shown in FIG. 13, Mica content and linear expansion coefficient in perpendicular direction is substantially proportional relationship.

It should be noted that the modified PPE containing 50% of inorganic substance has linear expansion coefficient a of 20 to $30\times10^{-6}$ in the resin flow direction upon molding in the temperature range of −30° C. to 100° C.

Here, for certainly attaining strength of the secondary bobbin 2, it should be natural that greater thickness of the bobbin is better. However, since the pencil coil is typically required to be inserted into a thin plug hole in the extent of $\phi$19 to $\phi$28 mm, the external diameter of the coil portion to be inserted there into should be in a extent of $\phi$18 to $\phi$27 mm including the side core. Within such narrow space, epoxy resin 8 has to be filled between the components, such as the coil casing 6, the primary coil 5, the primary bobbin 4, the secondary coil 3, the secondary bobbin 2, the center core 1 and so forth and a gap defined in the components so as to fill up the defect. Accordingly, the thicknesses of respective parts are desire to be as small as possible.

In the shown embodiment, the thickness of the primary bobbin is set at 0.5 mm to 1.2 mm, the thickness of the secondary bobbin is set at 0.7 to 1.6 mm, and a length of the bobbin is set at 50 to 150 mm.

The secondary coil 3 to be wound around the secondary bobbin 2 has a linear expansion coefficient of about $22\times10^{-6}$ at −40° C. in a condition where epoxy resin is impregnated between wire. On the other hand, the primary coil 5 to be wound around the primary bobbin 4 has a linear expansion coefficient of about $22\times10^{6}$ at −40° C. in the condition where epoxy resin is impregnated between wire. It should be noted that the linear expansion coefficient is determined by a testing method in accordance with ASTM D 696.

The secondary coil 3 is separately wound about 5000 to 35000 turns in total using enamel line having line diameter of about 0.03 to 0.1 mm. On the other hand, the primary coil 5 is wound about 100 to 300 turns in total over several layers (here two layers) with winding several tens turns per each layer using enamel line having line diameter of about 0.3 to 1.0 mm. Outer sheath structure of the primary coil will be discussed later.

The primary bobbin 4 is formed of PBT containing rubber. The reason why PBT is used, is for attaining a linear expansion coefficient comparable with or in a range ±10% of the linear expansion coefficient of epoxy resin 8. Furthermore, by containing rubber, bonding ability with epoxy resin 8 can be increased. Particularly, the composition of the material of the primary coil is 55 Wt % of PBT, 5 Wt % of rubber, 20 Wt % of glass fiber, 20 Wt % of plate form elastmer. It is also possible to form the primary bobbin and the secondary bobbin with the same PPS material to lower total cost.

Figure 9:
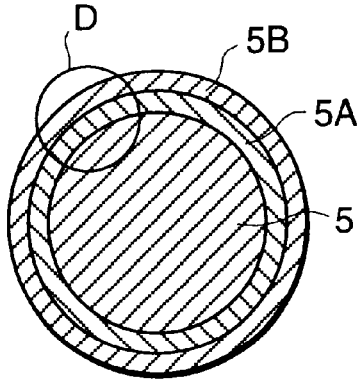
FIG. 9 is a section of the primary coil to be employed in the foregoing embodiment.

For the primary coil 5, in addition to a coating 5A of insulative material (for example, ester imide, amide imide, urethane or the like) in a thickness of 10 to 20 μm around copper line (φ500 to 800 μm) as shown in diagrammatic illustration of FIG. 9, a coating (overcoating) 5B to be easily separating the primary coil 5 from the insulative resin (epoxy resin) 8 filled around the primary coil, are provided. The overcoating 5B is prepared by adding any one of nylon, polyethylene, Teflon or the like to provide sliding ability to the same material as the insulative material 5A in a content of several %, and the thickness thereof is 1 to 5 μm.

The reason why overcoating having not so high bonding ability to the epoxy resin 8, is to reduce stress component σ1 created in the secondary bobbin among stress σ created in the secondary bobbin by a difference of thermal shrinkages of the primary coil 5 and the secondary coil 2 (linear expansion coefficient difference) (for satisfying the foregoing condition).

Figure 4:
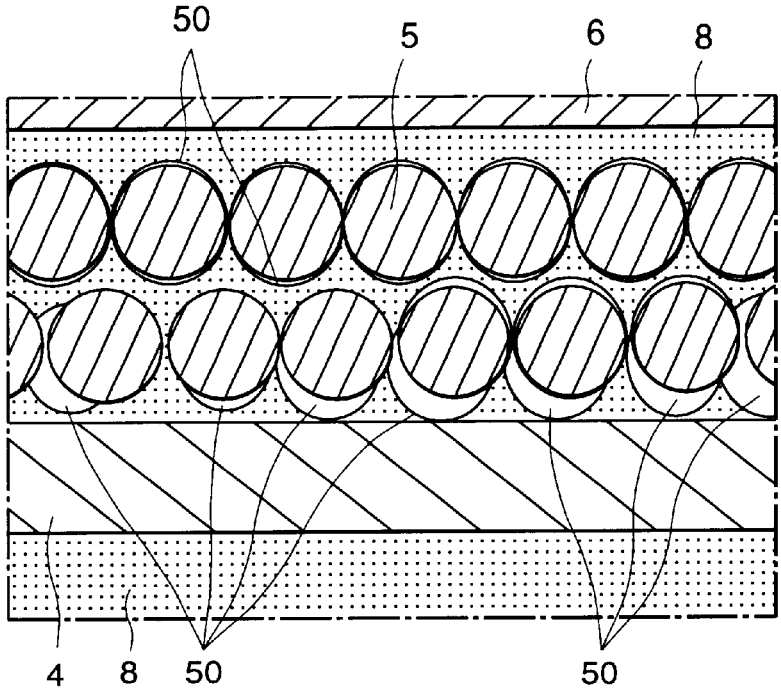
FIG. 4 is an enlarged section of portion C FIG. 2.

Namely, by presence of the foregoing overcoating 5B, a delaminated portion (gap) 50 is formed between the primary coil 5 and the epoxy resin 8 presented around the primary coil 5 as shown in FIG.4. The delaminated portion 50 may also be formed between the epoxy resin 8 filled between the primary bobbin 4 and the primary coil 5 and the primary coil 5 or between the layers of the primary coil 5. It should be noted that FIG. 4 is an enlarged section of the portion C of FIG. 2 and is drawn based on tomogram (30 to 40 times of magnification) of microscope taken on the portion corresponding to the portion C.

By interposing the gap (delaminated portion) 50 between the primary bobbin 4 and the primary coil 5 or between the layers of the primary coil 5, it becomes possible to block a path of tension force (tension force based on difference of heat expansion) of the primary coil and the secondary bobbin) in circumferential direction acting from the primary coil 5 to the secondary bobbin. Accordingly, by reducing the stress component σ1 applied by the presence of the primary coil among stress σ created within the secondary bobbin, σ can be reduced (weaken) in the extent greater than or equal to 20%. Also, the linear expansion coefficient of the modified PPE is improved by blending more than or equal to 20% of inorganic filler as set forth above for reducing internal stress (thermal stress) by improvement of material of the secondary bobbin. According to example of CAE analysis by the inventors, the stress σ generated in the circumferential direction of the secondary bobbin 2 (also in perpendicular direction relative to resin flow direction in molding of the bobbin, hereinafter referred to as θ direction) can be significantly reduced by multiplier effect with stress weakening effect of the gap 50.

Figure 12:
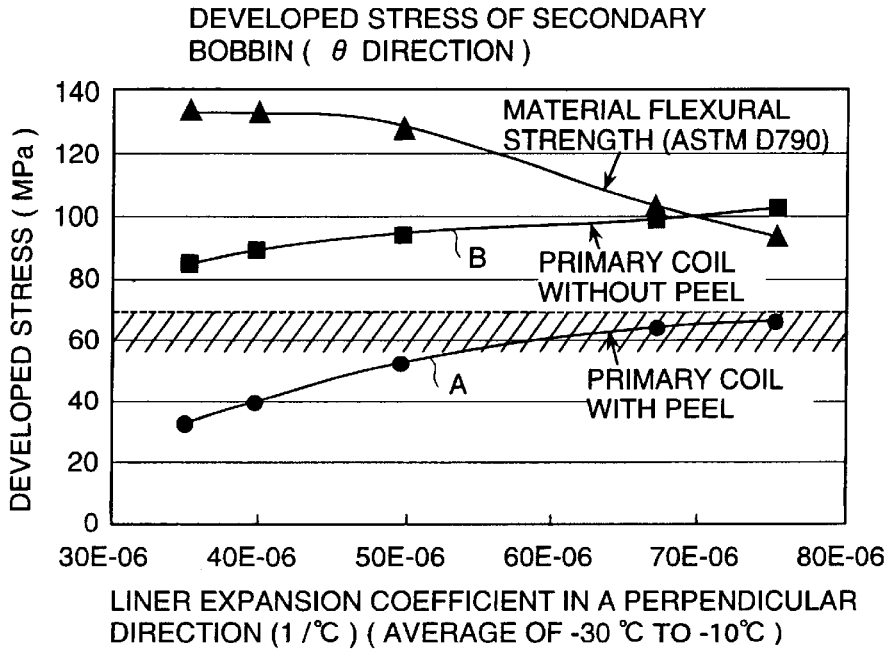
FIG. 12 is a diagrammatic illustration showing a relationship between a linear expansion coefficient in peripheral condition (perpendicular direction relative to flow direction in resin molding) of a secondary bobbin and a stress generated in the secondary bobbin.

FIG. 12 shows the relationship between the linear expansion coefficient in the direction perpendicular to the resin flow direction (axial direction of the bobbin) of the secondary bobbin and the stress generated in the secondary bobbin (θ direction), in the shown embodiment.

The generated stress (thermal stress) of the secondary bobbin of FIG. 12 is derived as internal stress in θ direction to be created at −40° C. by generating three-dimensional model of the ignition coil using the CAE analysis soft ware and inputting material property values (linear expansion coefficient, Young's modulus, Poisson's ratio) of respective parts, and taking the stress generated at a temperature of 130° C. for curing epoxy. The linear expansion coefficient in the property value uses the material of the secondary bobbin of 35 to $75\times10^{-6}$ in average at −30° C. to −10° C., as approximated value of −40° C.

In FIG. 12, the solid line A corresponds to the shown embodiment (one provided the foregoing delaminated portion 50 around the primary coil), in which, with taking the secondary bobbin material (gas filler 20 Wt % base of FIG. 12 with Mica content of 0 Wt %, 20 Wt % and 30 Wt %) exemplified in FIG. 13 into account, CAE analysis is performed using one having the linear expansion coefficient of 35 to $75\times10^{-6}$ in average in the temperature range of −30° C. to −10° C. as an approximated value of the linear expansion coefficient of the secondary bobbin, particularly using approximated linear expansion coefficient at −40° C. in θ direction of five secondary bobbins having linear expansion coefficients of about $40\times10^{-6}$ (strictly $39.6\times10^{-6}$), about $50\times10^{-6}$(strictly $49.3\times10^{-6}$), about $70\times10^{-6}$ (strictly $66.8\times10^{-6}$), $35\times10^{-6}$ and $75\times10^{-6}$ as tolerance.

As a result of analysis, when the average of the linear expansion coefficient of the secondary bobbin at approximately −40° C. (−30° C. to −10° C.) is 35 to $75\times10^{-6}$ (the lower limit value 35 of the average is based on restriction of the blending amount of the inorganic filler capable of molding of the secondary bobbin), analysis result where the stress generated by the secondary bobbin becomes 70 MPa [allowable upper limit of internal stress (thermal stress) of the secondary bobbin taken as target by the inventors].

Figure 14:
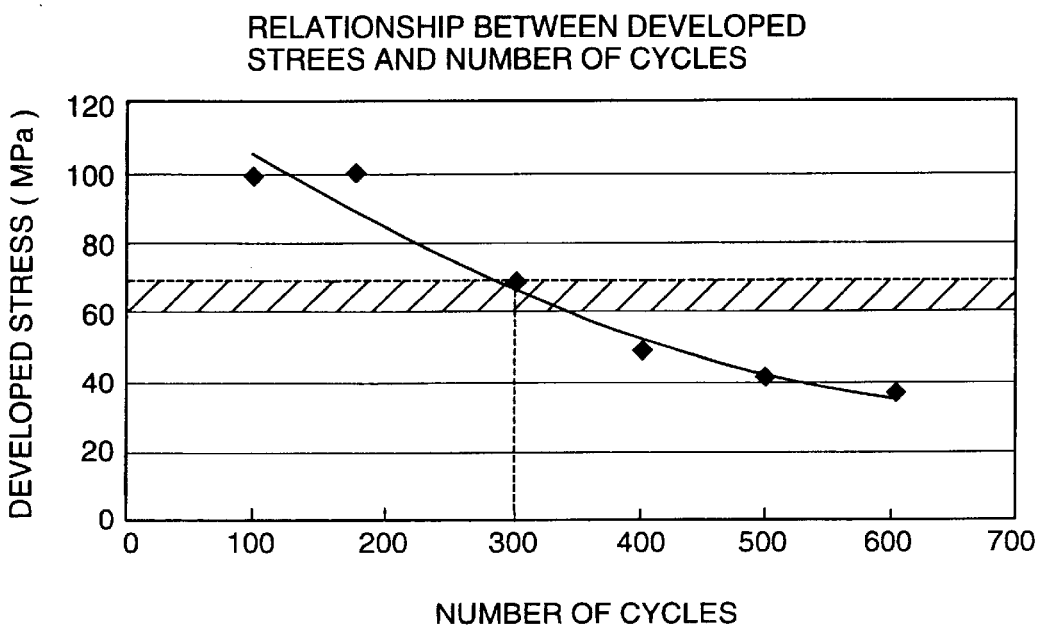
FIG. 14 is a diagrammatic illustration showing a stress generated in the secondary bobbin and number of heat cycle.

While less than or equal to 70 MPa of the generated stress is based on CAE analysis by the inventors, base of the numerical value is passed heat cycle test (test repeating temperature variation in a range of 130° C. to −40° C.) sufficiently satisfying durability of the ignition coil for the internal combustion engine of this kind. FIG. 14 is an illustration showing a characteristic test of generated stress in the secondary coil 2 and number of heat cycles, in which a horizontal axis represents number of heat cycles and a vertical axis represents generated stress, and the range less than or equal to 70 MPa is the range where crack is not caused in the secondary bobbin 2 at 300 times or more of the heat cycle.

The solid line B in FIG. 12 shows comparative example representative of result of analysis of generated stress of the secondary bobbin in the case where the linear expansion coefficient in the θ direction is set similar to that of the solid line A in the ignition coil, in which the foregoing delaminated portion 50 is not provided around the primary coil. In this case, the generated stress in the circumferential direction of the secondary bobbin becomes greater than or equal to 80 MPa.

Even if the foregoing delaminated portion 50 us provided between the primary bobbin 4 and the primary coil 5 and between the layers in the primary bobbin 5, since the primary coil 5 low potential (substantially ground potential), concentration of the electric field between the primary coil is not caused. Furthermore, by tightly fitting the secondary coil 3, the epoxy resin 8 and the primary bobbin 4 without forming gap, insulation between the primary coil and the secondary coil can be certainly attained. In addition, it has been confirmed as a result of test by the inventors to satisfactorily achieve prevention of concentration of electric field by line voltage of the secondary coil.

Particularly, in the shown embodiment, by using PBT containing rubber in the primary bobbin 4, bonding ability with the epoxy resin 8 can be increased and delamination of the epoxy resin 8 on the inner diameter side of the primary bobbin 4 can be certainly prevented to achieve good insulation performance by maintaining bonding ability between the secondary coil 3, the epoxy resin 8 and the primary bobbin 4.

It should be noted that the primary bobbin 4 may be formed of thermoplastic resin, such as PPS (polyphenyl sulfide), modified PPE or the like.

For the coil casing 6, thermoplastic resin, such as PBT, PPS modified PPE or the like may be used. On the outer surface of the coil casing, the side cores 7 are mounted. The side core 7 is cooperated with the center core 1 for forming the magnetic path, and is formed by rounding thin silicon steel plate or directional silicon steel plate in the thickness of 0.3 mm to 0.5 mm into cylindrical form.

The reference numeral 20 denotes an ignition circuit unit (igniter) coupled with the upper portion of the coil casing 6. Within a unit casing 20*a*, an electronic circuit (ignition driver circuit 23) for driving the ignition coil is housed, and a connector portion 21 for external connection is integrally molded with the unit casing 20*a*.

Figure 7:
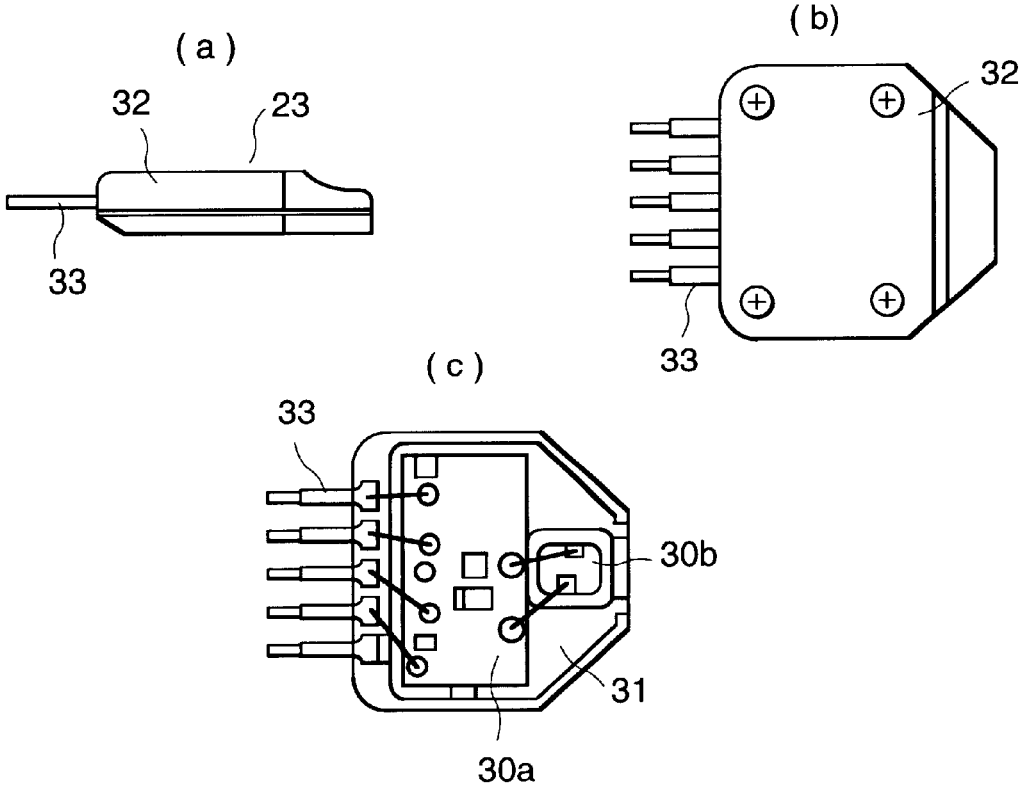
FIG. 7(*a*) is a front elevation showing an ignition driver circuit to be used in the foregoing embodiment, to be transfer molded, (*b*) is its top plan view, and (*c*) is a top plan view showing a condition where the ignition driver circuit is mounted and before transfer molding.

The ignition driver circuit 23 in the shown embodiment is finally transfer molded. FIG. 7(*a*) shows a front elevation of an independent product of the ignition driver circuit 23, (*b*) is a top plan view thereof, and (*c*) shows a condition where hybrid IC 30*a* and a power element (semiconductor chip) 30*b* for the ignition driver circuit are mounted on a base (substrate) 31 with a terminal 33 before transfer molding. As shown in FIGS. 7(*a*) to (*c*), after mounting the hybrid IC 30*a* and the power element 30*b* on the base 31, transfer molding 32 is provided.

Figure 6:
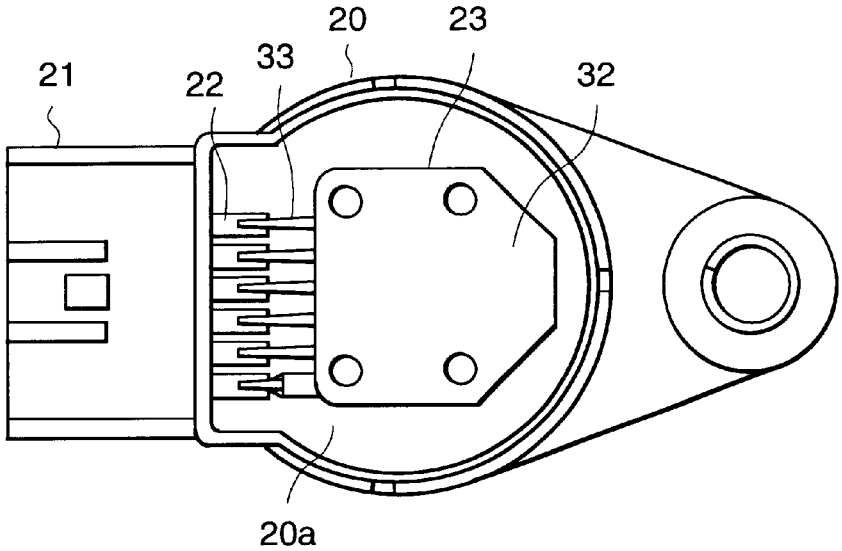
FIG. 6 is a top plan view of an igniter casing of the foregoing embodiment.

FIG. 6 shows a condition where the transfer molded ignition driver circuit 23 is mounted in the unit casing 20*a*. Upon mounting, after connecting the terminal 33 of the ignition driver circuit 23 and the connector terminal 22 on the side of the unit casing 20*a*, epoxy resin 8 is filled and cured in the unit casing 8, which is illustrated in the condition where the transfer molded ignition driver circuit 23 is seen through. The ignition driver circuit 23 is buried with the epoxy resin 8.

In the shown embodiment, circuit elements other than a power transistor among the ignition driver circuit 23, which are not suited for integration into a chip, for example, noise suppressing capacitor (eliminated from illustration) is externally mounted on outside of a pencil coil. The noise suppressing capacitor is arranged between a not shown power source line and ground and prevents noise generated by power supply control of the ignition coil By employing such transfer molded ignition driver circuit 23, the ignition driver circuit 23 can be integrated into single chip to advantageously simplified the manufacturing process to lower a cost, input current can be made small, and so on.

The reference numeral 11 denotes a high voltage diode, 12 denotes a leaf spring, , 13 denotes a high voltage terminal, 14 denotes a spring for connection with the ignition plug connection, and 15 denotes a rubber boots for connection of the ignition plug. The high voltage diode 11 serves for preventing excessively advanced ignition when a high voltage generated in the secondary coil 3 is supplied to the ignition plug via the leaf spring 12, the high voltage terminal 13 and the spring 14.

Major operations and effects of the shown embodiment are as follows.

(1) Even the independent ignition type ignition coil subject to severe temperature environment as installed within the plug hole, the internal stress (thermal stress) σ generated in the secondary bobbin can be made small.

Accordingly, with the shown embodiment, the internal stress σ of the secondary bobbin can be significantly reduced to certainly prevent cranking (longitudinal cracking prevention) of the secondary bobbin. For testing, temperature variation in a range of 130° C. to −40° C. is repeatedly applied for 300 times to observe the secondary bobbin 2. Then, it has been confirmed that damage is not caused in the secondary bobbin 2 and good condition can be maintained.

(2) On the other hand, even when the gap 50 is provided as set forth above, since bonding ability (tight fitting ability) of epoxy resin to the secondary bobbin 2 and bonding ability of epoxy resin for inner side of the primary bobbin 4 are high, highly reliable pencil coil can be provided without sacrificing insulation ability.

It should be noted that, in the foregoing embodiment, the gap 50 is formed between the primary coil 4 and the insulative resin 9 there around. However, the effect (1) of the shown embodiment set forth above can be expected even when the gap portion (laminated portion) 51 is formed between the insulative resin (epoxy resin) 8 filled between the primary bobbin 4 and the primary coil 5 as shown in FIG. 5, and the primary bobbin 5.

Figure 5:
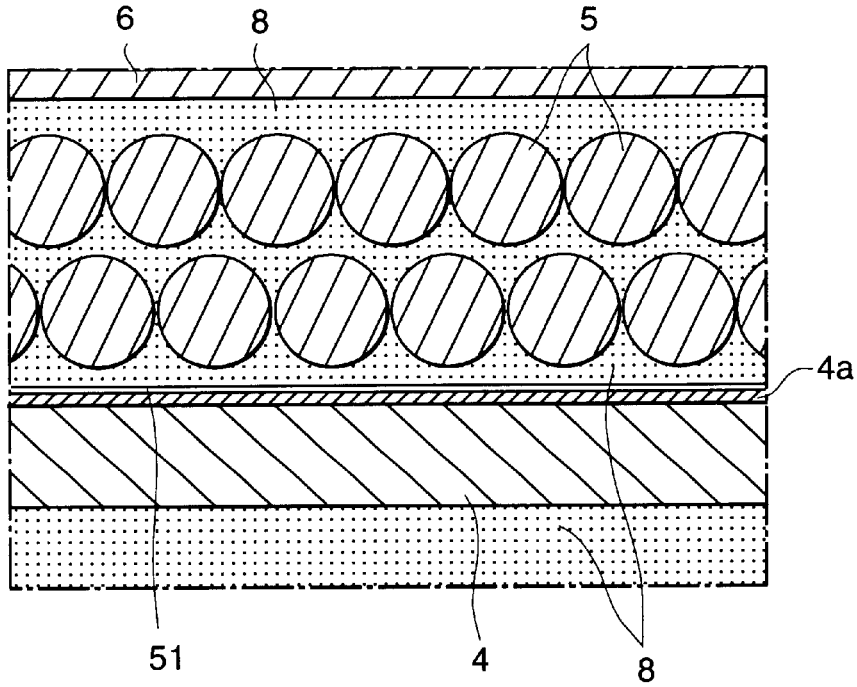
FIG. 5 is an enlarged section of portion C of another embodiment of the present invention.

For example, in the embodiment shown in FIG. 5, on the bobbin surface (surface on outside of the bobbin) on the side where the primary coil is wound, among the primary bobbin 4, by applying the overcoating 4A (coating layer of coating) which easy to separate between the bobbin surface and the epoxy resin facing the bobbin surface, formation of the gap portion 51 is assured. The material of the overcoating 4A is similar material as the overcoating set forth above. On the other hand, it is also possible to stick a sheet having small bonding force to epoxy on the outer surface of the primary bobbin instead of the overcoating set forth above.

On the other hand, it is also possible to provide both of the foregoing gaps 50 and 51.

Figure 15:
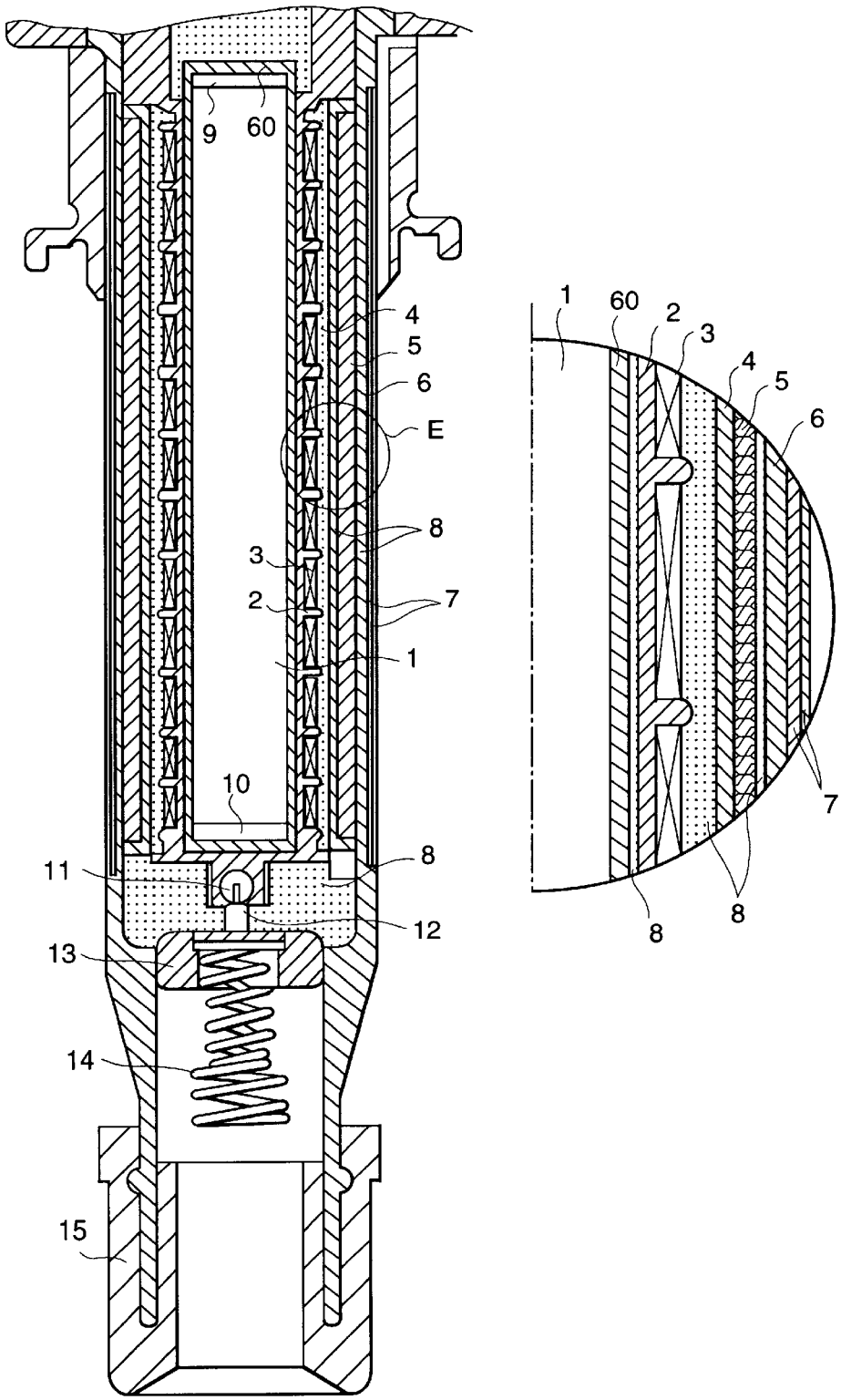
FIG. 15 is a longitudinal section of another embodiment of the ignition coil for the internal combustion engine according to the present invention and an enlarged section of a portion E.

FIG. 15 is a partially eliminated section showing another embodiment of the present invention. While not illustrated, between the primary bobbin 4 and the primary coil 4 and/or between the layers of the primary coil 5, stress reducing gaps (delaminated portions) 50 and 51 similar to the above are provided. On the other hand, the construction thereof is similar to the embodiment set forth above except for the following point. The same reference numerals to the foregoing embodiment identify the same or common elements.

Namely, what is different from the embodiment set forth above, is that instead of filling the soft epoxy resin 17 between the center core 1 and the secondary bobbin 2, the center core 1 is preliminarily coated with an insulating member 60, such as silicon rubber, urethane, acryl resin or the like before arranging inside of the secondary bobbin 2, in place. The coated center core is arranged within the secondary bobbin, and hard epoxy resin 8 is filled between the center core land the secondary bobbin 2.

With the shown embodiment, in addition to achievement of similar effect to the first embodiment, the following operation and effect can be achieved. By absorbing heat shock between the center core 1 and the secondary bobbin 2 by the elastic member (center core coating) 60, it can contribute for reducing of thermal stress σ of the secondary bobbin. Furthermore, in comparison with the operation for filling and curing the soft epoxy resin into the narrow space between the secondary bobbin and the center core (filling and curing under vacuum pressure), the center core coating 60 can be done for the independently. Also,normal filling and curing of hard epoxy resin between the center core and the secondary bobbin to be performed after insertion of the center core 1 with the coating into the secondary bobbin, can be easily performed for low viscosity in comparison with the soft epoxy to achieve lowering of operation cost. In addition, absorbing of magnetic vibration generated from the center core can be efficient to reduce lowering of noise.

The shown ignition coil is constructed with a circuit shown in FIG. 5 of Japanese Patent Application Laid-Open No. 10-325384, and operates as shown in FIG. 8 in the same publication.

In the primary coil 5, coatings 5A and 5B of insulative body (for example ester imide, amide imide, urethane or the like) of thickness of 10 to 20 $\mu$m is provided around the copper line ($\phi$500 to 800 $\mu$m) as diagrammatically shown in FIG. 9. In the shown embodiment, the first coating 5A is ester imide and the second coating 5B is amide imide to form two layer coating.

Figure 16:
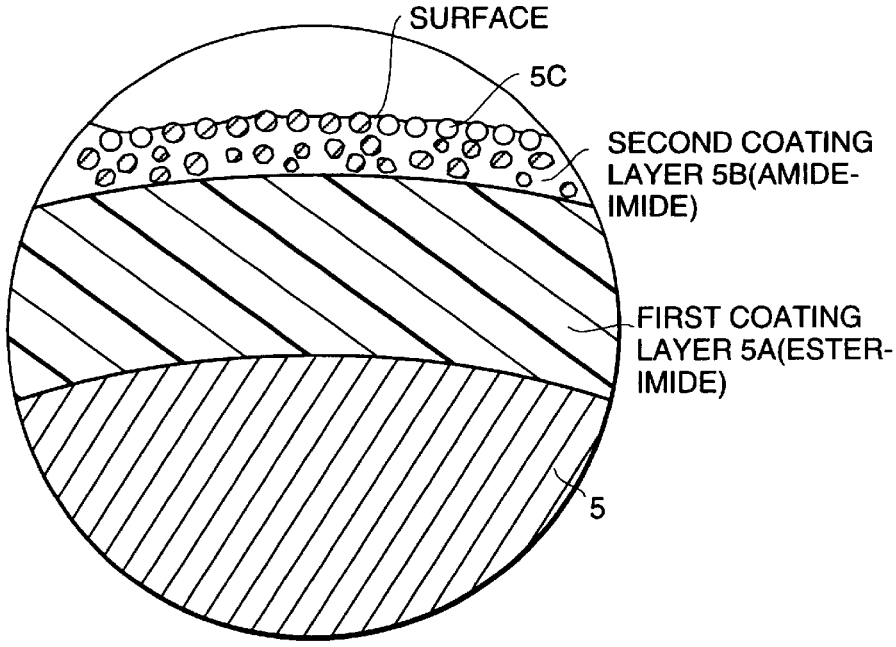
FIG. 16 is an enlarged section of a portion D of FIG. 9.

As diagrammatically shown in FIG. 16, the outer coating 5B contains a component 5C having no affinity or not chemically react with epoxy resin (for example, nylon, polyolefin, such as polyethylene, polypropylene, fluorinated resin, fluorinated elastmer fluorinated rubber, wax, fatty acid ester). In the shown embodiment, discussion will be given particularly with respect to fatty acid ester. Fatty acid ester has better dispersion property in varnish condition before baking of the coating in comparison with low molecular weight polyethylene, and has lower melting point than amide imide to be precipitated on the surface of the coating. Furthermore, fatty acid ester contains non-polar hydrocarbon component ($CH_2CH_2$) to have no affinity with epoxy resin.

Therefore, bonding force between the surface of the primary coil and epoxy resin becomes small. A thickness of amide imide layer is in a range of 0.05 im to 5 im. No delamination effect cannot be attained at the content of fatty acid ester less than 2 to 10% by weight with taking content of amide imide as 100% by weight, and if the content of fatty acid ester in excess of 10% by weight, heat resistance can be lowered.

When nylon or fluorinated material is used as a component not affinity or cause chemical coupling with the insulative resin, making process is increased to result in cost up.

As set forth above, the reason why the component 5C having no compatibility with epoxy resin 8 is to reduce the stress component 61 (for satisfying the foregoing condition ① created within the secondary bobbin by thermal shrinkage difference (linear expansion coefficient difference) between the primary coil 5 and the secondary bobbin 2 among stress 6 created within the secondary bobbin.

Also, it becomes possible to reduce delamination by thermal stress acting on the interface between the secondary coil and the secondary bobbin.

As set forth above, in the independent ignition type ignition coil which is subject to severe temperature environment as installed within the plug hole, it becomes possible to reduce thermal stress of the secondary coil due to linear expansion coefficient difference between component members, ensure prevention of cracking in the secondary bobbin, and achieve high quality and high reliability of the ignition coil assembly of this kind by maintaining good electrical insulation.

What is claimed is:

1. An independent ignition type ignition coil for an internal combustion engine to be used by directly connecting with each ignition plug of the internal combustion engine, in which a center core, a secondary coil wound around a secondary bobbin, and a primary coil wound around a primary bobbin are coaxially arranged in sequential order from inside within a coil casing, and insulative resin being filled between these components, wherein said primary coil having a coating film or coating layer containing non-polar hydrocarbon as component having no affinity or not causing chemical reaction to an insulative resin.

2. An independent ignition type ignition coil for an internal combustion engine to be used by directly connecting with each ignition plug of the internal combustion engine, in which a center core, a secondary coil wound around a secondary bobbin, and a primary coil wound around a primary bobbin are coaxially arranged in sequential order from inside within a coil casing, and insulative resin being filled between these components, wherein said primary coil having a coating film or coating layer containing $-(CH_2CH_2)-n(n\geqq 2)$ or $-[CH_2—CH(CH_3)]-n(n\geqq 2)$ as component having no affinity or not causing chemical reaction to an insulative resin.

3. An independent ignition type ignition coil for an internal combustion engine to be used by directly connecting with each ignition plug of the internal combustion engine, in which a center core, a secondary coil wound around a secondary bobbin, and a primary coil wound around a primary bobbin are coaxially arranged in sequential order from inside within a coil casing, and insulative resin being filled between these components, wherein an outermost coating of said primary coil having a coating film or coating layer containing any one of nylon, polyolefin such as polyethylene, polypropylene or the like, fluorinated resin, fluorinated elastmer, fluorinated rubber, wax, fatty acid ester as component having no affinity or not causing chemical reaction to an insulative resin.

4. An ignition coil for an internal combustion engine as set forth in claim 1, wherein said secondary bobbin is PPS or modified PPE.

5. An independent ignition type ignition coil for an internal combustion engine to be used by directly connecting with each ignition plug of the internal combustion engine, in which a center core, a secondary coil wound around a secondary bobbin, and a primary coil wound around a primary bobbin are coaxially arranged in sequential order from inside within a coil casing, and insulative resin being filled between these components, wherein said secondary bobbin being for med of PPS material, said primary bobbin being formed of PPS material, an inner insulating coating on a surface of wire of said primary coil being formed with a first coating taking ester imide as primary component and a second coating on outside of said first coating and taking amide imide as primary component, said second coating containing non-polar hydrocarbon having lower melting point than amide imide, and epoxy resin being filled between wire of said primary coil.

6. An independent ignition type ignition coil for an internal combustion engine to be used by directly connecting with each ignition plug of the internal combustion engine, in which a center core, a secondary coil wound around a secondary bobbin, and a primary coil wound around a primary bobbin are coaxially arranged in sequential order from inside within a coil casing, and insulative resin being filled between these components, wherein said secondary bobbin being formed of modified PPE material, said primary bobbin being formed of PBT material, an inner insulating coating on a surface of wire of said primary coil being formed with a first coating taking ester imide as primary component and a second coating on outside of said first coating and taking amide imide as primary component, said second coating containing non-polar hydrocarbon having lower melting point than amide imide, and epoxy resin being filled between wire of said primary coil.

7. An ignition coil as set forth in claim 2, wherein said secondary bobbin is PPS or modified PPE.

8. An ignition coil as set forth in claim 3, wherein said secondary bobbin is PPS or modified PPE.

* * * * *